US010208268B2

(12) United States Patent
E et al.

(10) Patent No.: US 10,208,268 B2
(45) Date of Patent: Feb. 19, 2019

(54) GREASE COMPOSITION FOR CONSTANT VELOCITY JOINTS

(71) Applicant: GKN Driveline International GmbH, Lohmar (DE)

(72) Inventors: Jisheng E, Hennef (DE); Stefanie Rosenkranz, Wachtberg-Oberbachem (DE); Jörg Berlingen, Köln (DE); Frank Reher, Siegburg (DE)

(73) Assignee: GKN Driveline International GmbH, Lohmar (DE)

( * ) Notice: Subject to any disclaimer, the term of this patent is extended or adjusted under 35 U.S.C. 154(b) by 0 days.

(21) Appl. No.: 15/560,219

(22) PCT Filed: Mar. 31, 2015

(86) PCT No.: PCT/EP2015/000689

§ 371 (c)(1),
(2) Date: Sep. 21, 2017

(87) PCT Pub. No.: WO2016/155754

PCT Pub. Date: Oct. 6, 2016

(65) Prior Publication Data

US 2018/0051227 A1 Feb. 22, 2018

(51) Int. Cl.
*C10M 141/10* (2006.01)
*C10M 169/00* (2006.01)
(Continued)

(52) U.S. Cl.
CPC ..... *C10M 169/00* (2013.01); *C10M 141/10* (2013.01); *C10M 169/045* (2013.01); *C10M 169/06* (2013.01); *C10M 2203/1025* (2013.01); *C10M 2203/1065* (2013.01); *C10M 2205/0285* (2013.01); *C10M 2207/106* (2013.01); *C10M 2219/044* (2013.01); *C10M 2219/068* (2013.01);
(Continued)

(58) Field of Classification Search
CPC .... C10M 2207/1206; C10M 2219/046; C10M 2219/068; C10M 2223/045
USPC ..... 508/390, 369, 408, 519
See application file for complete search history.

(56) References Cited

U.S. PATENT DOCUMENTS 6,656,890 B1 12/2003 Fish et al.
2003/0176295 A1* 9/2003 Ozaki ..... C10M 141/00 508/179
(Continued)

FOREIGN PATENT DOCUMENTS

EP 1811012 A1 7/2007
GB 2346892 A 8/2000
(Continued)

OTHER PUBLICATIONS

International Search Report and Written Opinion for PCT/EP2015/000689 dated Nov. 27, 2015 (10 pages).

*Primary Examiner* — Vishal V Vasisth
(74) *Attorney, Agent, or Firm* — Bejin Bieneman PLC

(57) ABSTRACT

The disclosure relates to an improved grease composition for use in constant velocity joints, especially ball joints and/or tripod joints used in the drivelines of motor vehicles, with the grease composition comprising at least one base oil, at least one simple or complex soap thickener, at least one zinc sulphonate, at least one molybdenum dithiocarbamate in the solid state, and at least one molybdenum dithiophosphate.

14 Claims, 4 Drawing Sheets

(51) Int. Cl.
*C10M 169/04* (2006.01)
*C10M 169/06* (2006.01)

(52) U.S. Cl.
CPC ... *C10M 2223/045* (2013.01); *C10N 2210/01* (2013.01); *C10N 2210/02* (2013.01); *C10N 2210/06* (2013.01); *C10N 2230/06* (2013.01); *C10N 2230/12* (2013.01); *C10N 2230/36* (2013.01); *C10N 2240/046* (2013.01); *C10N 2250/10* (2013.01)

(56) References Cited

U.S. PATENT DOCUMENTS

2011/0021391 A1* 1/2011 E ..... C10M 169/00
508/165
2015/0247105 A1* 9/2015 Yamazaki ..... C10M 169/06
508/365

FOREIGN PATENT DOCUMENTS

WO 9602615 A1 2/1996
WO 2007129775 A1 11/2007
WO 2008040382 A1 4/2008
WO 2009121378 A1 10/2009

* cited by examiner

GREASE COMPOSITION FOR CONSTANT VELOCITY JOINTS

CROSS-REFERENCE TO RELATED APPLICATIONS

This application is a national stage of, and claims priority to, Patent Cooperation Treaty Application No. PCT/EP2015/000689, filed on Mar. 31, 2015, which application is hereby incorporated herein by reference in its entirety.

BACKGROUND

Many rear-wheel drive and four-wheel drive cars as well as trucks have CV (constant velocity) joints. CV joints or homokinetic joints allow the drive shaft to transmit power though a variable angle, at constant rotational speed, preferably without an appreciable increase in friction or play. In front-wheel drive cars, CV joints deliver the torque to the front wheels during turns.

There are two types of CV joints that are most commonly used: a ball-type and a tripod-type. In front-wheel drive cars, ball-type CV joints are used on the outer side of the drive shafts (outer CV joints), while tripod-type CV joints are mostly used on the inner side (inner CV joints). The motions of components within CV joints are complex with a combination of rolling, sliding and spinning. When the joints are under torque, the components are loaded together which can not only cause wear on the contact surfaces of the components, but also rolling contact fatigue and significant frictional forces between the surfaces.

Constant velocity joints also have sealing boots of elastomeric material which are usually of a bellows shape, one end being connected to the outer part of the CV joint and the other end to the interconnecting or output shaft of the CV joint. The boot retains the grease in the CV joint, and keeps out dirt and water.

Not only must the grease reduce wear and friction and prevent the premature initiation of rolling contact fatigue in a CV joint, it must also be compatible with the elastomeric material of which the boot is made. Otherwise there is a degradation of the boot material which causes premature failure of the boot, allowing the escape of the grease and ultimately failure of the CV joint. It is one of the most common problems with the CV joints that the protective boot cracks or gets damaged. Once this happens, in addition to the escape of the grease, moisture and dirt get in, causing the CV joint to wear faster and eventually fail due to lack of lubrication and corrosion. Usually, outer CV-joint boots break first, as they have to endure more movement than the inner ones. If a CV joint itself is worn out, it cannot be repaired; it will have to be replaced with a new or reconditioned part. The two main types of material used for CV joint boots are polychloroprene rubber (CR) and thermoplastic elastomer (TPE), especially ether-ester block co-polymer thermoplastic elastomer (TPC-ET).

Typical CV joint greases have base oils which are blends of naphthenic (saturated rings) and paraffinic (straight and branched saturated chains) mineral oils. Synthetic oils may also be added. It is known that said base oils have a large influence on the deterioration (swelling or shrinking) of both boots made of CR and TPC-ET. Both mineral and synthetic base oils extract the plasticizers and other oil soluble protective agents from the boot materials. Paraffinic mineral oils and poly-α-olefin (PAO) synthetic base oils diffuse very little into especially boots made of rubber material causing shrinkage, but on the other hand naphthenic mineral oils and synthetic esters diffuse into boot materials and act as plasticizers and can cause swelling. The exchange of plasticizer or plasticizer compositions for the naphthenic mineral oil can significantly reduce the boot performance, especially at low temperatures, and may cause the boot to fail by cold cracking, ultimately resulting in failure of the CV joint. If significant swelling or softening occurs, the maximum high speed capability of the boot is reduced due to the poor stability at speed and/or excessive radial expansion.

In order to solve the aforesaid problems, U.S. Pat. No. 6,656,890 B1 suggests a special base oil combination comprising 10 to 35% by weight of one or more poly-α-olefins, 3 to 15% by weight of one or more synthetic organic esters, 20 to 30% by weight of one or more naphthenic oils, the remainder of the combination being one or more paraffinic oils, and, further, a lithium soap thickener, and a sulphur-free friction modifier, that may be a organo-molybdenum complex, and at least one molybdenum dithiophosphate (MoDTP), and a zinc dialkyldithiophosphate and further additives such as anti-oxidants, extreme pressure additives, and tackiness agents. However, the friction coefficient and the wear of grease compositions according to U.S. Pat. No. 6,656,890 B1 as measured in SRV (abbreviation for the German words Schwingungen, Reibung, Verschleiβ) tests needs to be improved. This holds in particular for the friction coefficient at an early stage of the running-in process, e.g., measured at about 6 minutes.

SUMMARY

Disclosed herein is a grease composition, primarily for use in constant velocity joints, which has a good compatibility with boots made of rubber or thermoplastic elastomer, and which also gives enhanced endurance, low wear and low friction in CV joint, e.g., ball joints and/or tripod joints, which are used in the drivelines of motor vehicles. Further, the present disclosure relates to a constant velocity joint comprising the disclosed grease composition.

A grease composition for use in constant velocity joints comprises:

a) at least one base oil;

b) at least one simple or complex soap thickener;

c) at least one zinc sulphonate;

d) at least one molybdenum dithiocarbamate in the solid state; and e) at least one molybdenum dithiophosphate;

wherein the ratio between the wt-% amount of the at least one zinc sulphonate and both the amount of the at least one molybdenum dithiocarbamate and the amount of the at least one molybdenum dithiophosphate is in a range between approximately 0.2:1 to approximately 2.5:1; wherein the total amount of the at least one zinc sulphonate, of the at least one molybdenum dithiocarbamate as well as of the at least one molybdenum dithiophosphate being 10 wt-% at the most, referring to the total amount of the grease composition; and wherein the at least one molybdenum dithiophosphate acts as a metal surface activator of at least the at least one zinc sulphonate.

In addition to a grease composition, the disclosure relates to the use of a grease composition in constant velocity joints. Further, the disclosure relates to a constant velocity joint comprising a grease composition.

Zinc dialkyldithiophosphate (ZDTP) is a well-known anti-wear additive. It provides anti-wear performance based on a tribo-chemical reaction on the metal surfaces of constant velocity joints (CVj). Thereby, a layer on the metal surface is formed comprising zinc, sulphur, iron, oxygen and phosphorus as elements. In grease compositions for using CV joint, further sulphur containing substances such as olefine sulphide, alkylpolysulphide and so on are commonly used as EP additives. Such sulphur containing substances provide EP performance by reacting on the metal surfaces of the CV joints forming a complex sulphur surface.

The disadvantage of using ZDTPs and/or sulphur containing EP additives is that they are not compatible with sealing materials, especially sealing boots. In large quantities, the grease might therefore result in an early failure of the boots used in CV joints.

The advantage of the present composition for use in constant velocity joints is that the use of ZDTP and conventional sulphur containing EP additives is not required. Instead of ZDTP, zinc sulphonate (ZSN) is used.

However, in zinc sulphonate, the sulphur features more stable bonds than in the case of ZDTP and conventional EP additives. Therefore, it is required to activate zinc sulphonate (ZSN), in particular the sulphur in zinc sulphonate, for enabling the tribo-chemical reaction on metal surfaces. Without such an activation of the sulphur bonds, the zinc sulphonate does not efficiently provide anti-wear properties.

It has been found that molybdenum dithiophosphate (MoDTP) in suitable amounts enables the zinc sulphonate and the molybdenum dithiocarbamate (MoDTC) in the solid state to provide advantageous anti-wear and EP performance, in particular improved anti-friction properties at early running-times (run-in) of the CV joints. In this respect, it has been found that molybdenum dithiophosphate (MoDTP) acts as an activating agent for zinc sulphonate (ZSN) and at least one molybdenum dithiocarbamate (MoDTC) in the solid state. Consequently, the zinc sulphonate (ZSN), the molybdenum dithiocarbamate (MoDTC) in the solid state and the MoDPT act together synergistically.

As far as the term weight percent (wt-%) is used with respect to the components being comprised from the claimed grease composition, the term weight percent (wt-%) refers to a percentage of the total amount of the grease composition (i.e., percent of total weight) throughout this specification, except where expressly stated otherwise.

In the context of the invention, the expressions "about" and "approximately" in connection with numerical values or ranges are to be understood as a tolerance range, which a person skilled in the art would consider as common or reasonable based on his or her general knowledge and in view of the disclosed subject matter as a whole. In particular, the expressions "about" and "approximately" refer to a tolerance range of ±20%, preferred ±10% and further preferred ±5% with respect to the designated value.

In the context of the disclosure, the expression "wt-%" is used as an abbreviation for weight percent if not indicated otherwise, it refers to the amount of one or more components relative to the total amount of the composition.

Preferably, the base oil composition used in the grease composition in accordance with the present invention comprises poly-α-olefines, napthenic oils, paraffinic oils, and/or synthetic organic esters.

As a base oil composition according to the present disclosure, a base oil composition as disclosed in U.S. Pat. No. 6,656,890 B1 may be used, the disclosure of which is incorporated herein by reference in its entirety. However, any further kind of base oil composition, especially a blend of mineral oils, a blend of synthetic oils or a blend of a mixture of mineral and synthetic oils may be used. The base oil composition should preferably have a kinematic viscosity of between about 32 and about 250 $mm^2/s$ at 40° C. and between about 5 and about 25 $mm^2/s$ at 100° C. The mineral oils preferably are selected from the group comprising at least one naphthenic oil and/or at least one paraffinic oil. The synthetic oils usable in the present invention are selected from a group comprising at least one poly-α-olefin (PAO) and/or at least one synthetic organic ester. The organic synthetic ester is preferably a dicarboxylic acid derivative having subgroups based on aliphatic alcohols. Preferably, the aliphatic alcohols have primary, straight or branched carbon chains with 2 to 20 carbon atoms. Preferably, the organic synthetic ester is selected from a group comprising sebacic acid-bis(2-ethylhexylester) ("dioctyl sebacate" (DOS)), adipic acid-bis-(2-ethylhexylester) ("dioctyl adipate" (DOA)), and/or azelaic acid-bis(2-ethylhexylester) ("dioctyl azelate (DOZ)).

If poly-α-olefin is present in the base oil composition, preferably poly-α-olefins are selected having a viscosity in a range from about 2 to about 40 centistokes at 100° C. The naphthenic oils selected for the base oil composition have preferably a viscosity in a range between about 3 to about 370 $mm^2/s$, more preferably about 20 to about 150 $mm^2/s$ at 40° C., whereas if paraffinic oils were present in the base oil composition, preferably the paraffinic oils have a viscosity in a range between about 9 to about 170 $mm^2/s$ at 40° C.

In the sense of the present disclosure, the at least one thickener is preferably a lithium soap. A lithium soap is a reaction product of at least one fatty acid with lithiumhydroxide. Preferably, the thickener may be a simple lithium soap formed from stearic acid, 12-hydroxy stearic acid, hydrogenated castor oil or from other similar fatty acids or mixtures thereof or methylesters of such acids. Alternatively, or additionally, a lithium complex soap may be used, formed, for example, from a mixture of long-chained fatty acids together with a complexing agent, for example a borate of one or more dicarboxylic acids. The use of complex lithium soaps allows the grease composition according to the present disclosure to operate up to a temperature of about 180° C., whereas with simple lithium soaps, the grease composition will only operate up to a temperature of about 120° C. However, mixtures of all of the aforesaid thickeners may also be used.

The at least one zinc sulfonate (ZSN) is preferably present as a zinc salt of dinonylnaphthalene sulphonic acid and/or petroleum sulphonate and/or dodecyl benzene sulphonic acid. zinc sulfonate (ZSN) has the advantageous technical effect that it also acts as a corrosion inhibitor. Hence, no additional corrosion inhibitors are required in the composition, however may be added in addition.

The at least one molybdenum dithiocarbamate (MoDTC) according to the present disclosure is preferably of the following general formula (I):

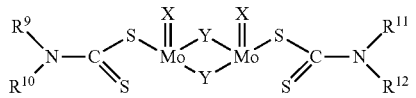

(I)

wherein X or Y represents S or O and each of R9 to R12 inclusive may be the same or different and each represents a primary (straight chain) or secondary (branched chain) alkyl group having between 3 and 20 carbon atoms.

Molybdenum dithiocarbamate (MoDTC) is present as solid molybdenum dithiocarbamate (MoDTC).

The at least one molybdenum dithiophosphate (MoDTP) is preferably of the following general formula (II):

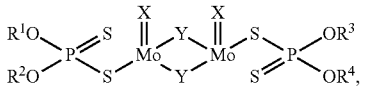

(II)

wherein X or Y represents S or O and each of $R^1$ to $R^4$ may be the same or different and each represents a primary (straight chain) or secondary (branched chain) alkyl group having between 6 and 30 carbon atoms.

Preferably, further molybdenum containing compounds may be present in the grease composition according to the present disclosure of which molybdenum compounds comprising sulfur and/or phosphorous are preferred and organic molybdenum compounds comprising sulfur or/and phosphorous are further preferred. The grease composition according to the present disclosure preferably contains one or more of molybdenum dithiocarbamates (MoDTCs) in the solid state, but also may also contain at least one MoDTC in the solid state and at least one MoDTC in the liquid state.

In an embodiment, the composition does not contain any sulfur-free and/or phosphorous-free molybdenum containing compounds.

In an embodiment, an anti-oxidant, i.e., an anti-oxidation agent, is present in the grease composition. As an anti-oxidation agent, the grease composition may comprise an amine, preferably an aromatic amine, more preferably phenyl-α-naphthylamine or di-phenylamine or derivatives thereof. The anti-oxidation agent is used to prevent deterioration of the grease composition associated with oxidation. The grease composition according to the present disclosure may range between about 0.1 to about 2% by weight, referred to the total amount to the grease composition, of an anti-oxidation agent (anti oxidant) in order to inhibit the oxidation degradation of the base oil composition, as well as to lengthen the life of the grease composition, thus prolonging the life of the CV joint.

Further, the present disclosure refers to the use of a grease composition in constant velocity joints, and, further, to a constant velocity joint comprising a grease composition as claimed. The constant velocity joint especially encompasses a boot, the boot being filled with the grease composition in accordance with the present disclosure, at least in part, the boot having a first attachment region which is assigned to a joint, and a second attachment region which is assigned to a shaft. The boot may be fixed with usual clamp devices on the joint and/or shaft.

The at least one base oil is preferably present in an amount of about 60 wt-% up to about 95 wt-%, further preferred in an amount of about 66 wt-% up to about 94 wt-%, further preferred in an amount of about 72 wt-% up to about 93 wt-%, further preferred in an amount of about 78 wt-% up to about 92 wt-%, and even further preferred in an amount of about 84 wt-% up to about 91 wt-%.

The at least one thickener is preferably present in an amount of about 2 wt-% up to about 15 wt-%, further preferred in an amount of about 2.8 wt-% up to about 13.2 wt-%, further preferred in an amount of about 3.6 wt-% up to about 11.4 wt-%, further preferred in an amount of about 4.4 wt-% up to about 9.6 wt-%, and even further preferred in an amount of about 5.2 wt-% up to about 7.8 wt-%.

The at least one zinc sulfonate (ZSN) is present in an amount of about 0.3 wt-% up to about 4 wt-%, further preferred in an amount of about 0.5 wt-% up to about 3 wt-%, and is further preferred present in an amount between approximately 0.7 wt-% and approximately 2.6 wt-%. The zinc sulphonate comprises preferably sulphur in an amount between approximately 33 wt-% and approximately 50 wt-%, the wt-% referring to the total amount of the zinc sulphonate. The zinc sulphonate further comprises zinc in an amount between approximately 1.9 wt-% and approximately 3.8 wt-%, the wt-% referring to the total amount of the zinc sulphonate.

The at least one molybdenum dithiocarbamate (MoDTC) in the solid state is preferably present in an amount of about 0.7 wt-%, preferably in an amount of approximately 1 wt-%, up to approximately 3 wt-%, preferably up to about 2.6 wt-%, further preferred in an amount of about 0.86 wt-% up to about 2.38 wt-%, further preferred in an amount of about 1.02 wt-% up to about 2.16 wt-%, further preferred in an amount of about 1.18 wt-% up to about 1.94 wt-%, and even further preferred in an amount of about 1.34 wt-% up to about 1.72 wt-%.

The at least one molybdenum dithiophosphate (MoDTP) may be present in an amount of about 0.1 wt-% up to about 2.2 wt-%, and is preferably present in an amount between approximately 0.3 wt-% and approximately 2.5.5 wt-%, further preferred in an amount of about 0.2.2 wt-% up to about 1.88 wt-%, further preferred in an amount of about 0.3 wt-% up to about 1.56 wt-%, further preferred in an amount of about 0.4 wt-% up to about 1.24 wt-%, and even further preferred in an amount of about 0.5 wt-% up to about 1 wt-%.

The at least one zinc sulfonate (ZSN) is present in an amount (in wt-%) relative to, both, the at least one molybdenum dithiocarbamate (MoDTC) and the at least one molybdenum dithiophosphate (MoDTP) taken together (in wt-%) in a range between approximately 0.1:1 to approximately 5:1, preferably in a range between approximately 0.2:1 to approximately 2.5:1 and further preferred in a range between approximately 0.2:1 to approximately 1.5:1.

The total amount of the at least one zinc sulphonate, of the at least one molybdenum dithiocarbamate as well as of the at least one molybdenum dithiophosphate is 10 wt-% at the most, preferably 7 wt-% at the most, and further preferred 5 wt-% at the most relative to the total amount of the composition.

The at least one zinc sulfonate (ZSN) is present in an amount (in wt-%) relative to the at least one molybdenum dithiocarbamate (MoDTC) in a range between approximately 0.2:1 to approximately 2.5:1.

In a preferred embodiment, the composition comprises at least one base oil, at least one thickener, at least one zinc sulfonate (ZSN), at least one molybdenum dithiocarbamate (MoDTC) in the solid state, and at least one molybdenum dithiophosphate (MoDTP).

In a preferred embodiment, the composition comprises at least one base oil in an amount of about 65 wt-% up to about 90 wt-% with respect to the total amount of the composition, at least one thickener in an amount of about 4 wt-% up to about 20 wt-% with respect to the total amount of the composition, at least one zinc sulfonate (ZSN) in an amount of about 0.8 wt-% up to about 2.3 wt-% with respect to the total amount of the composition, at least one molybdenum dithiocarbamate (MoDTC) in the solid state in an amount of about 0.7 wt-%, preferably of approximately 1.2 wt-%, up to about 2.6 wt-% with respect to the total amount of the composition, and at least one molybdenum dithiophosphate (MoDTP) in an amount of about 0.4 wt-% up to about 2.2 wt-% with respect to the total amount of the composition.

In an embodiment, the composition comprises at least one of poly-α-olefines and/or naphthenic oils and/or parafinic oils and/or synthetic organic esters, at least one of simple or complex lithium soap, at least one of zinc salts of dinonylnaphthalene sulphonic acid and/or petroleum sulphonate and/or dodecyl benzene sulfphonic acid, at least one molybdenum dithiocarbamate (MoDTC) in the solid state, and at least one molybdenum dithiophosphate (MoDTP).

In an embodiment, the composition comprises at least one base oil, preferably poly-α-olefines and/or naphthenic oils and/or parafinic oils and/or synthetic organic esters, at least one thickener, preferably simple or complex lithium soap, at least one zinc sulfonate (ZSN), preferably zinc salts of dinonylnaphthalene sulphonic acid and/or petroleum sulphonate and/or dodecyl benzene sulfphonic acid, at least one molybdenum dithiocarbamate (MoDTC) in the solid state, preferably molybdenum dithiocarbamate (MoDTC) in the solid state, and at least one molybdenum dithiophosphate (MoDTP), preferably molybdenum dithiophosphate (MoDTP).

In an embodiment, the composition comprises at least one base oil, preferably poly-α-olefines and/or naphthenic oils and/or parafinic oils and/or synthetic organic esters in an amount of about 70 wt-% up to about 90 wt-% with respect to the total amount of the composition, at least one thickener, preferably simple or complex lithium soap in an amount of about 4 wt-% up to about 15 wt-% with respect to the total amount of the composition, at least one zinc sulfonate (ZSN), preferably zinc salts of dinonylnaphthalene sulphonic acid and/or petroleum sulphonate and/or dodecyl benzene sulfphonic acid in an amount of about 0.8 wt-% up to about 2.3 wt-% with respect to the total amount of the composition, at least one molybdenum dithiocarbamate (MoDTC) in the solid state, preferably molybdenum dithiocarbamate (MoDTC) in the solid state in an amount of about 0.7 wt-%, preferably of approximately 1.2 wt-%, up to about 2.6 wt-% with respect to the total amount of the composition, and at least one molybdenum dithiophosphate (MoDTP), preferably molybdenum dithiophosphate (MoDTP) in an amount of about 0.4 wt-% up to about 2.2 wt-% with respect to the total amount of the composition.

In an embodiment, the composition comprises at least one of poly-α-olefines and/or naphthenic oils and/or parafinic oils and/or synthetic organic esters in an amount of about 70 wt-% up to about 90 wt-% with respect to the total amount of the composition, at least one of simple or complex lithium soap in an amount of about 4 wt-% up to about 15 wt-% with respect to the total amount of the composition, zinc salts of dinonylnaphthalene sulphonic acid and/or petroleum sulphonate and/or dodecyl benzene sulfphonic acid in an amount of about 0.8 wt-% up to about 2.3 wt-% with respect to the total amount of the composition, at least one molybdenum dithiocarbamate (MoDTC) in the solid state in an amount of about 0.7 wt-% up to about 2.6 wt-% with respect to the total amount of the composition, and at least one molybdenum dithiophosphate (MoDTP) in an amount of about 0.4 wt-% up to about 2.2 wt % with respect to the total amount of the composition.

In the preferred embodiments above, the ratio between the wt-% amount of the at least one zinc sulphonate and both the amount of the at least one molybdenum dithiocarbamate (MoDTC) and the amount of the at least one molybdenum dithiophosphate (MoDTP) is preferably in a range between approximately 0.2:1 to approximately 2.5:1, preferably in a range between approximately 0.2:1 to approximately 1.5:1, wherein the total amount of the at least one zinc sulphonate, of the at least one molybdenum dithiocarbamate (MoDTC) as well as of the at least one molybdenum dithiophosphate (MoDTP) being 10 wt-% at the most, referring to the total amount of the grease composition; and wherein the at least one molybdenum dithiophosphate (MoDTP) acts as a metal surface activator of at least the at least one zinc sulphonate.

A grease composition which comprises at least one base oil, at least one simple or complex soap thickener, at least one zinc sulphonate, at least one molybdenum dithiocarbamate (MoDTC) in the solid state and at least one molybdenum dithiophosphate (MoDTP), wherein the ratio between the wt-% amount of the at least one zinc sulphonate and both the amount of the at least one molybdenum dithiocarbamate (MoDTC) and the amount of the at least one molybdenum dithiophosphate (MoDTP) is in a range between approximately 0.2:1 to approximately 2.5:1, wherein the total amount of the at least one zinc sulphonate, of the at least one molybdenum dithiocarbamate (MoDTC) as well as of the at least one molybdenum dithiophosphate (MoDTP) being 10 wt-% at the most, referring to the total amount of the grease composition, and wherein the at least one molybdenum dithiophosphate (MoDTP) acts as a metal surface activator of at least the at least one zinc sulphonate, characterized in that the at least one zinc sulphonate is comprised in an amount approximately 0.7 wt-% and approximately 2.6 wt-%, referred to the total amount of the grease composition.

In an embodiment, the grease composition comprises at least one base oil, at least one simple or complex soap thickener, at least one zinc sulphonate, at least one molybdenum dithiocarbamate (MoDTC) in the solid state and at least one molybdenum dithiophosphate (MoDTP), wherein the ratio between the wt-% amount of the at least one zinc sulphonate and both the amount of the at least one molybdenum dithiocarbamate (MoDTC) and the amount of the at least one molybdenum dithiophosphate (MoDTP) is in a range between approximately 0.2:1 to approximately 2.5:1, preferably in a range between approximately 0.2:1 to approximately 1.5:1, wherein the total amount of the at least one zinc sulphonate, of the at least one molybdenum dithiocarbamate (MoDTC) as well as of the at least one molybdenum dithiophosphate (MoDTP) being 10 wt-% at the most, referring to the total amount of the grease composition, and wherein the at least one molybdenum dithiophosphate (MoDTP) acts as a metal surface activator of at least the at least one zinc sulphonate, wherein the at least one molybdenum dithiophosphate (MoDTP) is comprised in an amount of approximately 0.3 wt-% and approximately 2.5.5 wt-%, referred to the total amount of the grease composition.

In an embodiment, the grease composition comprises at least one base oil, at least one simple or complex soap thickener, at least one zinc sulphonate, at least one molybdenum dithiocarbamate (MoDTC) in the solid state and at least one molybdenum dithiophosphate (MoDTP), wherein the ratio between the wt-% amount of the at least one zinc sulphonate and both the amount of the at least one molybdenum dithiocarbamate (MoDTC) and the amount of the at least one molybdenum dithiophosphate (MoDTP) is in a range between approximately 0.2:1 to approximately 2.5:1, preferably in a range between approximately 0.2:1 to approximately 1.5:1, wherein the total amount of the at least one zinc sulphonate, of the at least one molybdenum dithiocarbamate (MoDTC) as well as of the at least one molybdenum dithiophosphate (MoDTP) being 10 wt-% at the most, referring to the total amount of the grease composition, and wherein the at least one molybdenum dithiophosphate (MoDTP) acts as a metal surface activator of at least the at least one zinc sulphonate, wherein the zinc sulphonate comprises sulphur in an amount of between approx. 33 wt-% and approximately 50 wt-%, the wt-% referring to the total amount of the zinc sulphonate.

In a preferred embodiment, the grease composition for use in constant velocity joints comprises at least one base oil, at least one simple or complex soap thickener, at least one zinc sulphonate, at least one molybdenum dithiocarbamate (MoDTC) in the solid state and at least one molybdenum dithiophosphate (MoDTP), wherein the ratio between the wt-% amount of the at least one zinc sulphonate and both the amount of the at least one molybdenum dithiocarbamate (MoDTC) and the amount of the at least one molybdenum dithiophosphate (MoDTP) is in a range between approximately 0.2:1 to approximately 2.5:1, preferably in a range between approximately 0.2:1 to approximately 1.5:1, to wherein the total amount of the at least one zinc sulphonate, of the at least one molybdenum dithiocarbamate (MoDTC) as well as of the at least one molybdenum dithiophosphate (MoDTP) being 10 wt-% at the most, referring to the total amount of the grease composition, and wherein the at least one molybdenum dithiophosphate (MoDTP) acts as a metal surface activator of at least the at least one zinc sulphonate and the zinc sulphonate is selected from a group comprising a zinc salt of dinonylnaphthalene sulphonic acid, petroleum sulphonate acid, and/or dodezyl benzene sulphonic acid.

In an embodiment, the grease composition comprises at least one base oil, at least one simple or complex soap thickener, at least one zinc sulphonate, at least one molybdenum dithiocarbamate (MoDTC) in the solid state and at least one molybdenum dithiophosphate (MoDTP), wherein the ratio between the wt-% amount of the at least one zinc sulphonate and both the amount of the at least one molybdenum dithiocarbamate (MoDTC) and the amount of the at least one molybdenum dithiophosphate (MoDTP) is in a range between approximately 0.2:1 to approximately 2.5:1, preferably in a range between approximately 0.2:1 to approximately 1.5:1, wherein the total amount of the at least one zinc sulphonate, of the at least one molybdenum dithiocarbamate (MoDTC) as well as of the at least one molybdenum dithiophosphate (MoDTP) being 10 wt-% at the most, referring to the total amount of the grease composition, and wherein the at least one molybdenum dithiophosphate (MoDTP) acts as a metal surface activator of at least the at least one zinc sulphonate and the thickener is selected from a group comprising at least one lithium soap and/or at least one lithium complex soap.

In an embodiment, the grease composition comprises at least one base oil, at least one simple or complex soap thickener, at least one zinc sulphonate, at least one molybdenum dithiocarbamate (MoDTC) in the solid state and at least one molybdenum dithiophosphate (MoDTP), wherein the ratio between the wt-% amount of the at least one zinc sulphonate and both the amount of the at least one molybdenum dithiocarbamate (MoDTC) and the amount of the at least one molybdenum dithiophosphate (MoDTP) is in a range between approximately 0.2:1 to approximately 2.5:1, preferably in a range between approximately 0.2:1 to approximately 1.5:1 wherein the total amount of the at least one zinc sulphonate, of the at least one molybdenum dithiocarbamate (MoDTC) as well as of the at least one molybdenum dithiophosphate (MoDTP) being 10 wt-% at the most, referring to the total amount of the grease composition, and wherein the at least one molybdenum dithiophosphate (MoDTP) acts as a metal surface activator of at least the at least one zinc sulphonate and the at least one base oil comprises poly-α-olefines, naphthenic oils, paraffinic oils, and/or synthetic organic esters.

In an embodiment, the grease composition for use in constant velocity joints comprises at least one base oil, at least one simple or complex soap thickener, at least one zinc sulphonate, at least one molybdenum dithiocarbamate (MoDTC) in the solid state and at least one molybdenum dithiophosphate (MoDTP), wherein the ratio between the wt-% amount of the at least one zinc sulphonate and both the amount of the at least one molybdenum dithiocarbamate (MoDTC) and the amount of the at least one molybdenum dithiophosphate (MoDTP) is in a range between approximately 0.2:1 to approximately 2.5:1, preferably in a range between approximately 0.2:1 to approximately 1.5:1 wherein the total amount of the at least one zinc sulphonate, of the at least one molybdenum dithiocarbamate (MoDTC) as well as of the at least one molybdenum dithiophosphate (MoDTP) being 10 wt-% at the most, referring to the total amount of the grease composition, and wherein the at least one molybdenum dithiophosphate (MoDTP) acts as a metal surface activator of at least the at least one zinc sulphonate and the at least one base oil comprises poly-α-olefines, naphthenic oils, paraffinic oils, and/or synthetic organic esters and wherein the composition comprises at least one anti-oxidant.

In a further embodiment, the grease composition comprises at least one base oil, at least one simple or complex soap thickener, at least one zinc sulphonate, at least one molybdenum dithiocarbamate (MoDTC) in the solid state and at least one molybdenum dithiophosphate (MoDTP), wherein the ratio between the wt-% amount of the at least one zinc sulphonate and both the amount of the at least one molybdenum dithiocarbamate (MoDTC) and the amount of the at least one molybdenum dithiophosphate (MoDTP) is in a range between approximately 0.2:1 to approximately 1.5:1, wherein the total amount of the at least one zinc sulphonate, of the at least one molybdenum dithiocarbamate (MoDTC) as well as of the at least one molybdenum dithiophosphate (MoDTP) being 10 wt-% at the most, referring to the total amount of the grease composition, and wherein the at least one molybdenum dithiophosphate (MoDTP) acts as a metal surface activator of at least the at least one zinc sulphonate and the at least one base oil comprises poly-α-olefines, naphthenic oils, paraffinic oils, and/or synthetic organic esters and wherein the composition comprises at least one anti-oxidant.

In a preferred embodiment, the grease composition for use in constant velocity joints comprises at least one base oil, at least one simple or complex soap thickener, at least one zinc sulphonate, at least one molybdenum dithiocarbamate (MoDTC) in the solid state and at least one molybdenum dithiophosphate (MoDTP), wherein the ratio between the wt-% amount of the at least one zinc sulphonate and both the amount of the at least one molybdenum dithiocarbamate (MoDTC) and the amount of the at least one molybdenum dithiophosphate (MoDTP) is in a range between approximately 0.2:1 to approximately 2.5:1, wherein the total amount of the at least one zinc sulphonate, of the at least one molybdenum dithiocarbamate (MoDTC) as well as of the at least one molybdenum dithiophosphate (MoDTP) being 10 wt-% at the most, referring to the total amount of the grease composition, and wherein the at least one molybdenum dithiophosphate (MoDTP) acts as a metal surface activator of the at least one zinc sulphonate, wherein it further comprises at least one anti-oxidation agent.

DETAILED DESCRIPTION

EXAMPLES

Figure 1A:
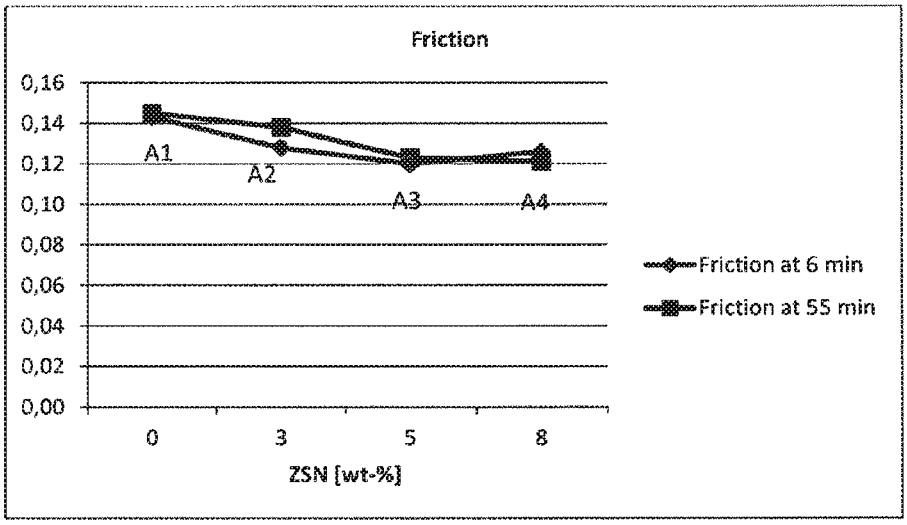
FIGS. 1*a* and 1*b*: Experimental results for friction and wear, respectively, as presented in Table 1, are shown for the common greases A1 to A5.

In order to determine the effect of the lowering of the friction coefficient as well as the wear by the grease composition according to the disclosure, SRV tests are carried out using an Optimol Instruments SRV tester. Flat disc lower specimen made of the 100Cr6 standard bearing steel from Optimol Instruments Prüftechnik GmbH, Westendstrasse 125, Munich, properly cleaned using a solvent are prepared and contacted with the grease composition to be examined. The SRV test is an industry standard test and is especially relevant for the testing of greases for CV joint. The test includes of an upper ball specimen with a diameter of 10 mm made from 100Cr6 bearing steel reciprocating under load on the flat disc lower specimen indicated above. In tests for mimicking tripod joints a frequency of 40 Hz (Hertz) with an applied load of 500 N (newtons) were applied for 60 minutes (including running-in) at 80° C. The stroke was 1.5 mm (millimeters). The friction coefficients obtained were recorded on a computer. For each grease, the reported value is an average of two data at the end of tests in two runs (two runs at 1.5 mm stroke). The running-in measurement of the friction coefficient is started with an applied load of 50 N for 1 minute under the above-specified conditions. Afterwards, the applied load is increased for 30 seconds by 50 N up to 500 N. Wear is measured using a profilometer and a digital planimeter. By using the profilometer, a profile of the cross section in the middle of the worn surfaces can be obtained. The area (S) of this cross section can be measured by using the digital planimeter. The wear quantity is assessed by V=SI, where V is the volume of the wear and I is the stroke. The wear rate ($W_r$) is obtained from $W_r$=V/L [μm/m], where L is the total sliding distance in the tests.

Further, the load carrying capacity (LCC) is measured in order to evaluate the extreme pressure performance of the grease composition in accordance with the present disclosure. It is determined in stepload tests with a frequency of 40 Hz with an applied load of 50 N for 15 minutes at the start at 80° C. The stroke was 1.5 mm. After the start test of 15 minutes, the load was increased step by step by 50 N for 15 minutes up to failure (the SRV test stops automatically once friction is higher than 0.3 for 30 seconds). The LCC is then determined as the maximum load without a failure during a time period of 15 minutes. The higher the values for the LCC, the better is the performance of the grease composition. The experimentally determined LCC values given in the Tables below are mean values of two separately determined values.

Further, tests regarding the properties of a thermoplastic elastomer boot, i.e. a TPE-boot, carried out with inventive grease composition C6 and with three commercial greases, i.e. commercial grease composition 1 for ball CV joints and commercial grease compositions 2 and 3 for tripod CV joints (see Table 9), were carried out with respect to the change of hardness (shore D) and the percentage change of tensile, elongation, and volume before and after a heat ageing of the boot material immersed in the grease at 125° C. for 336 hours. Said values are measured in accordance with ISO 868 (shore D), ISO 37 (tensile change and elongation change), and ISO 2781 (volume change).

The base oil composition as used for compositions A1 to A5, B1, B2 as well as C1 to C6, has a kinematic viscosity of about 165 $mm^2/s$ at 40° C. and about 16 $mm^2/s$ at 100° C. The base oil blend may be a mixture of one or more paraffinic oils in a range between about 10 to about 60% by weight, preferably about 20 to 40% by weight, one or more naphthenic oils in a range between about 30 to about 80% by weight, preferably about 55 to about 80% by weight, and, if necessary, one or more poly-α-olefins (PAO) in a range between about 5 to about 40% by weight, referred to the total amount of the oil mixture. The oil blend may further contain DOS in a range between about 2 to about 10% by weight, referred to a total amount of the oil mixture. The concrete oil blend used in the examples is made of 73% by weight of naphthenic oil SR130, produced by AB Nynäs Petroleum, Stockholm, Sweden, 25% by weight of paraffinc oil NS600, obtained from Total, and 2% by weight of DOS.

The naphthenic oils are selected with a range of viscosity between about 20 to about 180 $mm^2/s$ at 40° C., paraffinic oils between about 25 to about 400 $mm^2/s$ at 40° C., and PAO between about 6 and about 40 $mm^2/s$ at 100° C.

Commercial grease composition 1 is produced by BP Europa S.A, Germany. Commercial grease compositions 2 and 3 have been prepared according to U.S. Pat. No. 5,672,571 and GB 5,672,571.

As zinc sulfonate (ZSN) Vanlube IR-ZSN (Vanderbilt Chemicals, LLC, Norwalk, Conn., USA) was used.

As zinc dithiophosphate (ZDPT), RC3038 from Rhein Chemie was used.

As MoDTP, Molyvan L from Vanderbilt was used. As MoDTC (solid), Molyvan A from Vanderbilt was used. As S/P-free organo Molybdenum compound, Molyvan 855 from Vanderbilt was used.

As an anti-oxidant, Irganox L57 from BASF was used.

As Li soap thickener, Lithiumstearate obtained by reaction of 12-hydroxystearic acid with Lithiumhydroxide (LiOH) was used.

Common CV joint grease compositions without molybdenum compounds are designated as A1 to A5:

TABLE 1

| [wt %] | A1 | A2 | A3 | A4 | A5 |
|---|---|---|---|---|---|
| Li soap | 6 | 6 | 6 | 6 | 6 |
| Oils | 93.7 | 90.7 | 88.7 | 85.7 | 92.7 |
| Anti-oxidant | 0.3 | 0.3 | 0.3 | 0.3 | 0.3 |
| ZSN | — | 3 | 5 | 8 | — |
| ZDTP | — | — | — | — | 1 |

Comparative grease compositions comprising only MoDTC are designated as B1 and B2:

TABLE 2

| [wt %] | B1 | B2 |
|---|---|---|
| Li soap | 6 | 6 |
| Oils | 89.2 | 88.7 |
| Anti-oxidant | 0.3 | 0.3 |

TABLE 2-continued

| [wt %] | B1 | B2 |
|---|---|---|
| ZSN | 3 | 3 |
| MoDTC (solid) | .1.5 | .1.5 |
| MoDTP | — | — |
| S-/P-free organo Mo | — | 0.5 |

Inventive grease composition comprising ZSN, MoDTC (solid) and MoDTP are designated as C1 to C6:

TABLE 3

| [wt %] | C1 | C2 | C3 | C4 | C5 | C6 |
|---|---|---|---|---|---|---|
| Li soap | 6 | 6 | 6 | 6 | 6 | 6 |
| Oils | 91.2 | 90.7 | 89.7 | 88.7 | 88.2 | 89.2 |
| Anti-oxidant | 0.3 | 0.3 | 0.3 | 0.3 | 0.3 | 0.3 |
| ZSN | 0.5 | 1 | 2 | 3 | 3 | 2 |
| MoDTC (solid) | .1.5 | .1.5 | .1.5 | .1.5 | .1.5 | 2 |
| MoDTP | 0.5 | 0.5 | 0.5 | 0.5 | 1 | 0.5 |

Experimental values for friction at 6 min and 55 min and wear as well as LCC values are presented in Tables 4 to 8 and in FIGS. 1*a*, 1*b*, 2*a*, 2*b*, 3*a*, 3*b*, 4*a* and 4*b*.

Experimental results regarding the compatibility of the inventive composition with boot materials as compared to commercially available greases is presented in Table 9.

TABLE 4

| | A1 | A2 | A3 | A4 | A5 |
|---|---|---|---|---|---|
| ZSN | — | 3 | 5 | 8 | — |
| ZDTP | — | — | — | — | 1 |
| Friction at 6 min | 0.14 | 0.13 | 0.12 | 0.13 | 0.12 |
| Friction at 55 min | 0.15 | 0.14 | 0.12 | 0.12 | 0.11 |
| Wear ($\mu m^3/m$) | 4680 | 8047 | 11021 | 10719 | 538 |

TABLE 5

| | A2 | B1 | C4 |
|---|---|---|---|
| ZSN | 3 | 3 | 3 |
| MoDTC (solid) | — | .1.5 | .1.5 |
| MoDTP | — | — | 0.5 |
| Friction at 6 min | 0.13 | 0.122 | 0.102 |
| Friction at 55 min | 0.14 | 0.067 | 0.059 |
| Wear ($\mu m^3/m$) | 8047 | 518 | 238 |
| LCC (N) | n.d. | 800 | 850 |

TABLE 6

| | C4 | C5 |
|---|---|---|
| ZSN | 3 | 3 |
| MoDTC (solid) | .1.5 | .1.5 |
| MoDTP | 0.5 | 1 |
| Friction at 6 min | 0.102 | 0.081 |
| Friction at 55 min | 0.059 | 0.057 |

TABLE 6-continued

| | C4 | C5 |
|---|---|---|
| Wear ($\mu m^3/m$) | 238 | 375 |
| LCC (N) | 850 | 975 |

TABLE 7

| | C1 | C2 | C3 | C4 |
|---|---|---|---|---|
| ZSN | 0.5 | 1 | 2 | 3 |
| MoDTC (solid) | .1.5 | .1.5 | .1.5 | .1.5 |
| MoDTP | 0.5 | 0.5 | 0.5 | 0.5 |
| Friction at 6 min | 0.128 | 0.08 | 0.068 | 0.102 |
| Friction at 55 min | 0.08 | 0.098 | 0.061 | 0.059 |
| Wear ($\mu m^3/m$) | 469 | 679 | 543 | 238 |
| LCC (N) | 825 | 800 | 975 | 850 |

TABLE 8

| | C4 | B2 |
|---|---|---|
| ZSN | 3 | 3 |
| MoDTC (solid) | .1.5 | .1.5 |
| MoDTP | 0.5 | — |
| S-/P-free organo Mo | — | 0.5 |
| Friction at 6 min | 0.102 | 0.128 |
| Friction at 55 min | 0.059 | 0.128 |
| Wear ($\mu m^3/m$) | 238 | 10123 |
| LCC (N) | 850 | 375 |

TABLE 9

| Property | C6 | Commercial grease 3 | Commercial grease 1 | Commercial grease 2 |
|---|---|---|---|---|
| Hardness change (Shore D) | −5 | 0 | −10 | −8 |
| Tensile change (%) | −25.5 | −47.3 | −48 | −35.0 |
| Elongation change (%) | +3.6 | −21.1 | −15.0 | 16 |
| Volume change (%) | +16.3 | +14.5 | 20 | 17 |

Figure 1B:
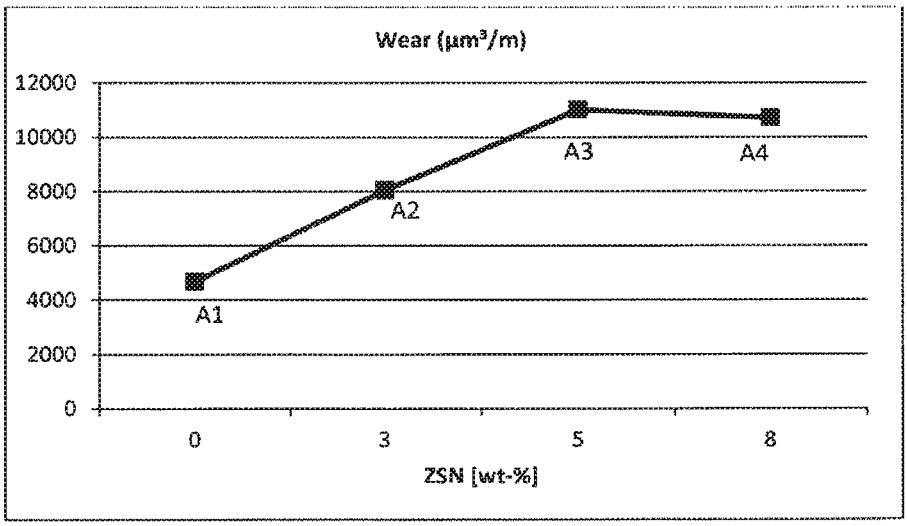

In Table 4 and FIGS. 1*a* and 1*b*, experimental results are presented for the common greases A1 to A5 which do not contain any molybdenum compounds at different or no amounts of zinc sulfonate (ZSN). Friction at 6 minutes and at 55 minutes decreases slightly upon increasing the amount of zinc sulfonate (ZSN) in the composition from 0 wt-% to 5 wt-%. Further increasing the amount of zinc sulfonate (ZSN) by 3 wt-% does not change the friction values at 55 minutes whereas the friction at 6 minutes increases very slightly. According to FIG. 1*b*, the wear increases by increasing amounts of zinc sulfonate (ZSN). A saturation value of the wear is achieved at about 5 wt-% zinc sulfonate (ZSN). Friction values of a composition comprising ZDTP are similar to the corresponding values for a composition of zinc sulfonate (ZSN).

ZDTP is a common anti wear additive. The disadvantage of using ZDTP is that it is not compatible with sealing materials, especially sealing boots. Composition A5 contains ZDTP instead of ZSN. According to the experimental results presented in Table 4, compositions with ZSN (A1 to A5) have significantly higher values for wear as compared to compositions with ZDTP. The results show that, although ZSN is more compatible with seal materials than ZDTP, in grease compositions without any molybdenum compounds ZSN cannot suitably replace ZDTP due to the poor anti-wear properties of ZSN, when used in compositions without molybdenum.

Figure 2A:
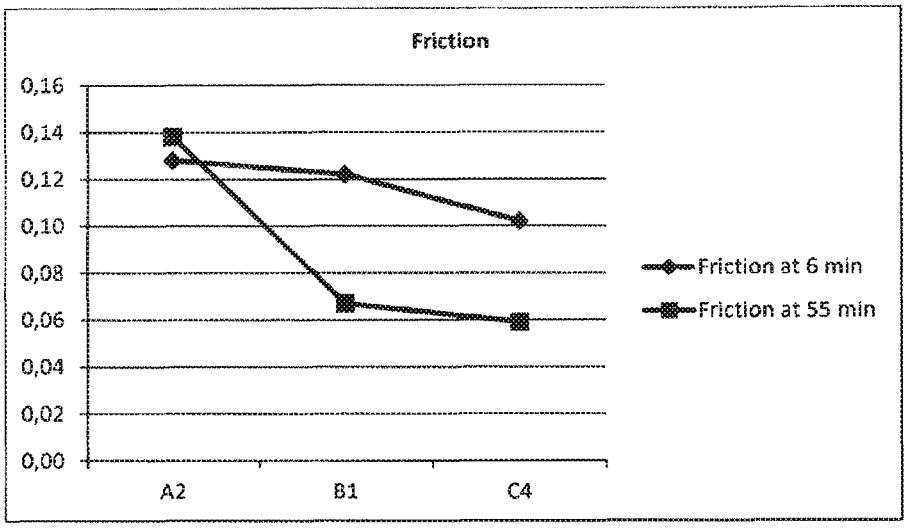
FIGS. 2*a* and 2*b*: Experimental results, as presented in Table 5, for friction and wear are shown, of an inventive example C4 and common grease composition A2 and comparative composition B1.
Figure 2B:
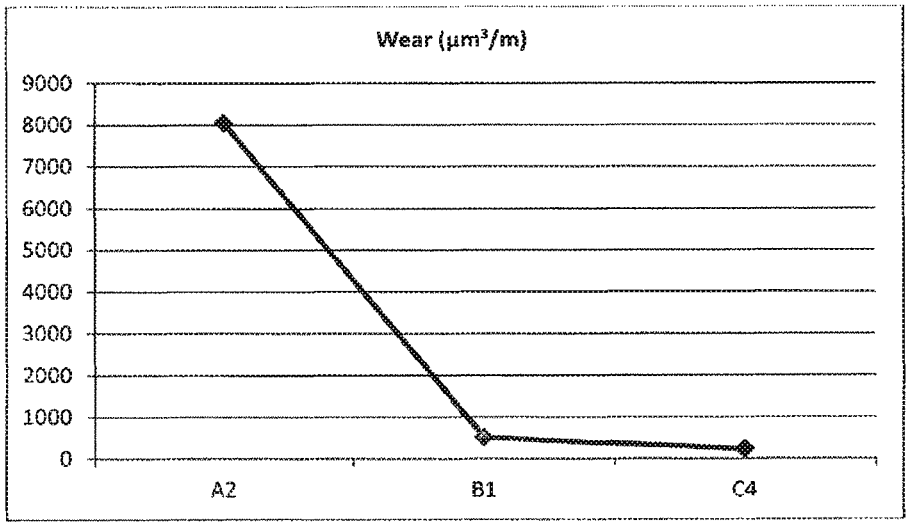

Table 5 and FIGS. 2*a* and 2*b* show the experimental results of composition C4 in comparison with common grease composition A1 and comparative grease composition B1 with ZSN being present in essentially the same amounts in the three compositions, i.e. 3 wt-%. The inventive composition C4 yields reduced wear and the friction values, notably a lower friction at 6 minutes. Hence, in a composition comprising zinc sulfonate (ZSN), at least one molybdenum dithiocarbamate (MoDTC) and at least one molybdenum dithiophosphate (MoDTP) results in low friction values even at an early stage of the running-in process of the CV joint, thereby preventing damages of CV joint which result from the bad performance of compositions known from the state of the art at an early stage of the running-in process. The compositions according to the disclosure, i.e. with dithiocarbamate (MoDTC) and at least one molybdenum dithiophosphate (MoDTP), provide advantageous anti-wear and anti friction values at suitable LCC values.

Figure 3A:
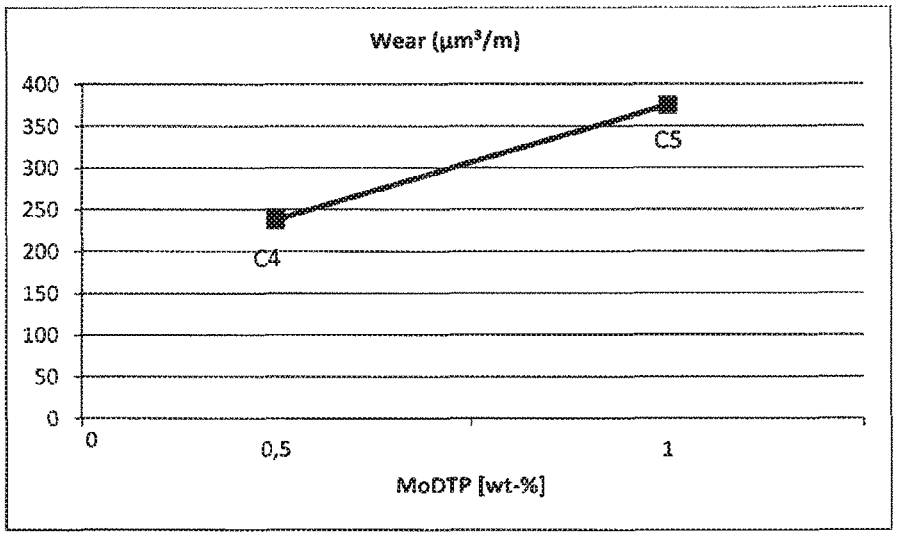
FIGS. 3*a* and 3*b*: Experimental results, as presented in Table 6, for friction and the wear are shown, respectively, of example inventive compositions C4 and C5 with different amounts of molybdenum dithiophosphate (MoDTP)
Figure 3B:
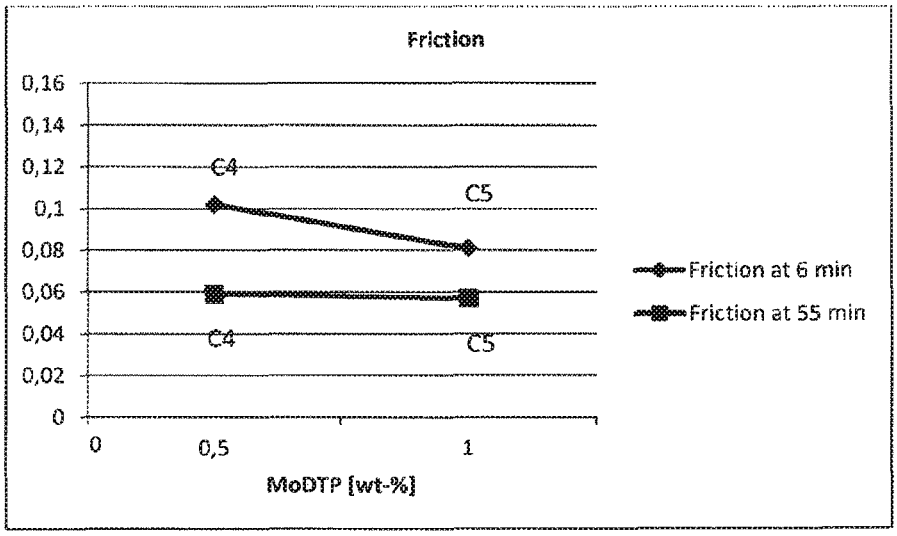

In Table 6 and FIGS. 3*a* and 3*b*, the friction and wear are shown for inventive compositions C4 and C5 with two different molybdenum dithiophosphate (MoDTP) amounts, i.e. at 0.5 wt-% and 1 wt-% molybdenum dithiophosphate (MoDTP). By increasing the amount of molybdenum dithiophosphate (MoDTP) from 0.5 wt-% to 1 wt-%, the wear increases. On the other hand, the friction at 6 minutes decreases upon increasing the molybdenum dithiophosphate (MoDTP) amount from 0.5 wt-% to 1 wt-%. All in all, these results show that the composition according to the disclosure provides advantageous overall properties even upon variation of the amount of MoDTP. This is further corroborated by the friction values at 55 minutes, which do not change significantly upon increasing the amount of molybdenum dithiophosphate (MoDTP).

Figure 4A:
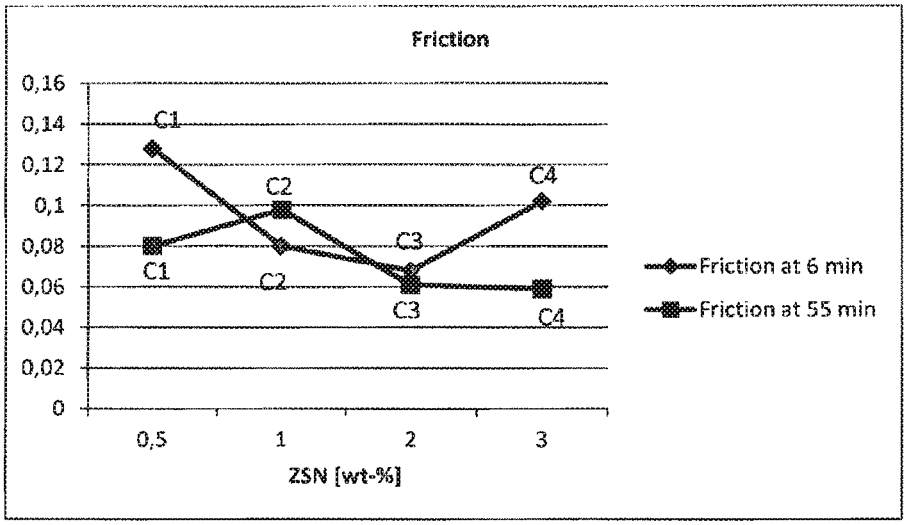
FIGS. 4*a* and 4*b*: Experimental results, as presented in Table 7, for friction and the wear are shown, respectively, of example inventive compositions C1 to C4 with different amounts of zinc sulfonate (ZSN).
Figure 4B:
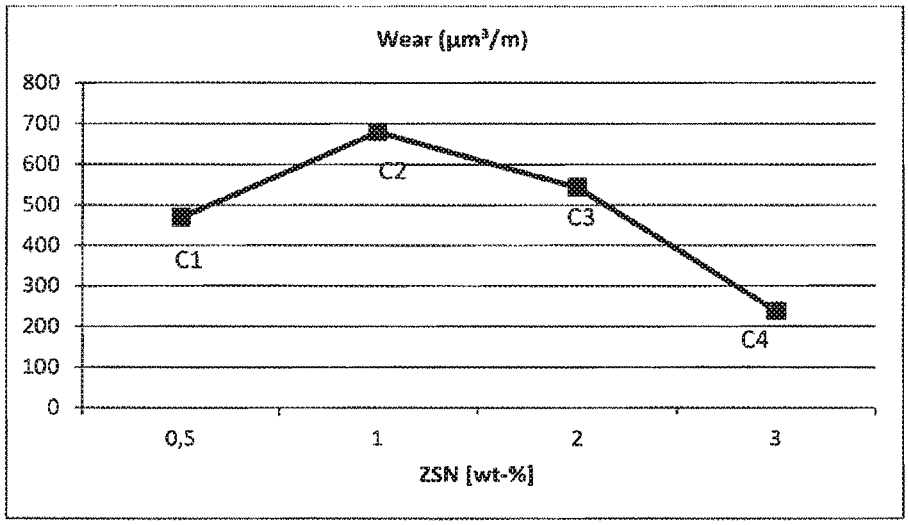

In Table 7 and the corresponding FIGS. 4*a* and 4*b*, the influence of different amounts of zinc sulfonate (ZSN) in the inventive compositions C1 to C4 comprising 1.5.5 wt-% molybdenum dithiocarbamate (MoDTC) and 0.5 wt-% molybdenum dithiophosphate (MoDTP) is presented. The zinc sulfonate (ZSN) amount is varied within a range from 0.5 wt-% to 3 wt-%. Friction values at 55 minutes show a maximum at 1 wt-% ZSN. On the other hand, friction values at 6 minutes show a minimum at a zinc sulfonate (ZSN) amount of about 1 to 2 wt-%. With respect to the wear, there is a maximum at a zinc sulfonate (ZSN) amount of 1 wt-%. Wear values decrease upon increasing the amount of zinc sulfonate (ZSN) from 1 wt-% to 3 wt-%. Generally speaking, upon changing the amount of ZSN, wear, friction at 6 min and friction at 55 minutes effectively change in different directions. All in all, the composition according to the disclosure provides advantageous overall properties even when the amount of ZSN is varied.

Table 8 demonstrates the advantageous effect of composition C4 relative to comparative composition B2, which comprises instead of MoDTP 0.5 wt-% sulphur- and phosphorus-free organic molybdenum compounds (S/P-free organo Mo). Replacing molybdenum dithiophosphate (MoDTP) by such compounds increases the wear dramatically while the friction values also increase.

In conclusion, these results show that it is in particular the use of molybdenum dithiophosphate (MoDTP) in combination with molybdenum dithiocarbamate (MoDTC) in the presence of zinc sulfonate (ZSN) which results in the advantageous values for friction and wear. These Mo-compounds cannot be replaced by simple organic molybdenum compounds.

The experimental results clearly show that the addition of MoDTP to compositions containing ZSN and MoDTC results in significantly better performances with respect to wear and friction. In particular, such compositions provide an advantageous performance with respect to wear and anti-friction properties even at an early stage of the running-in process. LCC values of the examples are above 800 N to 1000 N being values in suitable ranges.

Table 9 shows the compatibility of grease composition C6 with a CV joint boot (Pibiflex B5050 MWR) in comparison with commercial greases 1 to 3. Composition C6 provides less changes in hardness, lower tensile, elongation and volume change than commercial grease 1 and commercial grease 2. With respect to commercial grease 3, the inventive composition provides similar values with respect to a change of hardness and volume, but improved values regarding tensile change and elongation change.

The invention claimed is:

1. A grease composition for use in constant velocity joints comprising a) at least one base oil;

b) at least one simple or complex soap thickener;

c) at least one zinc sulphonate;

d) at least one molybdenum dithiocarbamate in the solid state; and e) at least one molybdenum dithiophosphate;

wherein the ratio between the percent-by-weight (wt-%) amount of the at least one zinc sulphonate and both the amount of the at least one molybdenum dithiocarbamate and the amount of the at least one molybdenum dithiophosphate is in a range between approximately 0.2:1 to approximately 2.5:1; wherein the total amount of the at least one zinc sulphonate is comprised in an amount between approximately 0.3 wt-% and approximately 3.0 wt-% of the total amount of the grease composition; wherein the total amount of the at least one zinc sulphonate, of the at least one molybdenum dithiocarbamate, as well as of the at least one molybdenum dithiophosphate, is at most 10 wt-% of the total amount of the grease composition; wherein the at least one molybdenum dithiophosphate acts as a metal surface activator of the at least one zinc sulphonate; and wherein the zinc sulphonate comprises sulphur in an amount between approximately 33 wt-% and approximately 50 wt-%, the wt-% referring to the total amount of the zinc sulphonate.

2. A grease composition in accordance with claim 1, wherein the at least one zinc sulphonate is comprised in an amount between approximately 0.7 wt-% and approximately 2.6 wt-% of the total amount of the grease composition.

3. A grease composition in accordance with claim 1, wherein the at least one molybdenum dithiocarbamate is comprised in an amount between approximately 1 wt-% and approximately 3 wt-% of the total amount of the grease composition.

4. A grease composition in accordance with claim 1, wherein the at least one molybdenum dithiophosphate is comprised in an amount between approximately 0.3 wt-% and approximately 2.5 wt-% of the total amount of the grease composition.

5. A grease composition in accordance with claim 1, wherein the zinc sulphonate comprises zinc in an amount between approximately 1.9 wt-% and approximately 3.8 wt-%, the wt-% referring to the total amount of the zinc sulphonate.

6. A grease composition in accordance with claim 1, wherein the zinc sulphonate is selected from a group comprising a zinc salt of dinonylnaphthalene sulphonic acid, petroleum sulphonate acid, and/or dodezyl benzene sulphonic acid.

7. A grease composition in accordance with claim 1, wherein the thickener is selected from a group comprising at least one lithium soap and/or at least one lithium complex soap.

8. A grease composition in accordance with claim 1, wherein the at least one base oil comprises poly-α-olefins, naphthenic oils, paraffinic oils, and/or synthetic organic esters.

9. A grease composition in accordance with claim 1, further comprising at least one anti-oxidation agent.

10. A grease composition in accordance with claim 1, further comprising approximately 65 wt-% to approximately 90 wt-% of at least one base oil, approximately 4 wt-% to approximately 20 wt-% of at least one simple or complex lithium soap thickener, approximately 0.8 wt-% to approximately 2.3 wt-% of at least one zinc sulphonate, approximately 1.2 wt-% to approximately 2.6 wt-% of at least one solid molybdenum dithiocarbamate, and approximately 0.4 wt-% to approximately 2.2 wt-% of at least one molybdenum dithiophosphate.

11. A grease composition in accordance with claim 1, wherein the grease composition consists of at least one base oil, at least one simple or complex soap thickener, at least one zinc sulphonate, at least one solid molybdenum dithiocarbamate, and at least one molybdenum dithiophosphate.

12. A grease composition in accordance with claim 1, wherein the grease composition consists of approximately 70 wt-% to approximately 90 wt-% of a base oil composition comprising naphthenic and parathenic oils, approximately 4 wt-% to approximately 15 wt-% of at least one simple or complex lithium soap thickener, approximately 0.8 wt-% to approximately 2.3 wt-% of at least one zinc sulphonate, approximately 1.2 wt-% to approximately 2.6 wt-% of at least one solid molybdenum dithiocarbamate, and approximately 0.4 wt-% to approximately 2.2 wt-% of at least one molybdenum dithiophosphate, in each case the wt-% values referring to the total amount of the grease composition.

13. A constant velocity joint comprising a grease composition comprising a) at least one base oil;

b) at least one simple or complex soap thickener;

c) at least one zinc sulphonate;

d) at least one molybdenum dithiocarbamate in the solid state; and e) at least one molybdenum dithiophosphate;

wherein the ratio between the percent-by-weight (wt-%) amount of the at least one zinc sulphonate and both the amount of the at least one molybdenum dithiocarbamate and the amount of the at least one molybdenum dithiophosphate is in a range between approximately 0.2:1 to approximately 2.5:1; wherein the total amount of the at least one zinc sulphonate is comprised in an amount between approximately 0.3 wt-% and approximately 3.0 wt-% of the total amount of the grease composition; wherein the total amount of the at least one zinc sulphonate, of the at least one molybdenum dithiocarbamate, as well as of the at least one molybdenum dithiophosphate, being at most 10 wt-% of the total amount of the grease composition; wherein the at least one molybdenum dithiophosphate acts as a metal surface activator of the at least one zinc sulphonate; and wherein the zinc sulphonate comprises sulphur in an amount between approximately 33 wt-% and approximately 50 wt-%, the wt-% referring to the total amount of the zinc sulphonate.

14. A grease composition in accordance with claim 1, wherein the at least one base oil is comprised in an amount between approximately 84 wt-% and approximately 92 wt-% of the total amount of the grease composition; the at least one simple or complex soap thickener is comprised in an amount between approximately 5.2 wt-% and approximately 7.8 wt-% of the total amount of the grease composition; the at least one zinc sulphonate is comprised in an amount between approximately 0.5 wt-% and approximately 3.0 wt-% of the total amount of the grease composition; the at least one molybdenum dithiocarbamate is comprised in an amount between approximately 1.34 wt-% and approximately 1.72 wt-% of the total amount of the grease composition; and the at least one molybdenum dithiophosphate is comprised in an amount between approximately 0.5 wt-% and approximately 1.0 wt-% of the total amount of the grease composition.

* * * * *